US008335451B2

(12) United States Patent
Kim et al.

(10) Patent No.: US 8,335,451 B2
(45) Date of Patent: Dec. 18, 2012

(54) DEVELOPING DEVICE TO PREVENT TONER LEAKAGE AND IMAGE FORMING APPARATUS INCLUDING THE SAME

(75) Inventors: Jong-in Kim, Suwon-si (KR); Min-sik Ji, Seoul (KR); Dong-uk Kim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 190 days.

(21) Appl. No.: 12/723,928

(22) Filed: Mar. 15, 2010

(65) Prior Publication Data

US 2011/0013929 A1 Jan. 20, 2011

(30) Foreign Application Priority Data

Jul. 16, 2009 (KR) ..... 10-2009-0064946

(51) Int. Cl.
*G03G 15/08* (2006.01)

(52) U.S. Cl. ..... 399/103

(58) Field of Classification Search ..... 399/103, 399/107, 110, 105, 106, 102
See application file for complete search history.

(56) References Cited

U.S. PATENT DOCUMENTS

2001/0021318 A1 9/2001 Hashimoto et al.
2001/0033757 A1 10/2001 Sato
2001/0036373 A1 11/2001 Higeta et al.
2002/0067930 A1 6/2002 Oguma et al.

FOREIGN PATENT DOCUMENTS

EP 2037331 3/2009

OTHER PUBLICATIONS

European Search Report issued Sep. 29, 2010 in EP Application No. 10158782.2.
Korean Office Action issued Jul. 26, 2011 in KR Application No. 10-2009-0064946.

*Primary Examiner* — Quana M Grainger
(74) *Attorney, Agent, or Firm* — Stanzione & Kim, LLP

(57) ABSTRACT

A developing device includes a housing containing toner having an opening at a side thereof, a developing roller supplying the toner supplied through the opening to a photoconductive drum, and a regulator contacting the outer circumference of the developing roller to regulate the amount of the toner supplied to the photoconductive drum. The housing also includes a lower frame having both side portions and a lower end portion respectively forming both edges and a lower edge of the opening in a lengthwise direction, and an upper frame welded and coupled to the lower frame and including a leading end portion forming an upper edge of the opening and a recess portion recessed from the leading end portion at both end portions of the leading end portion in the lengthwise direction. Both side portions of the lower frame includes a first surface contacting the recess portion to prevent the upper frame from being pushed toward the developing roller when the upper frame is welded and coupled to the lower frame.

21 Claims, 12 Drawing Sheets

DEVELOPING DEVICE TO PREVENT TONER LEAKAGE AND IMAGE FORMING APPARATUS INCLUDING THE SAME

CROSS-REFERENCE TO RELATED APPLICATIONS

This application claims priority under 35 USC §119 from Korean Patent Application No. 10-2009-0064946, filed on Jul. 16, 2009, in the Korean Intellectual Property Office, the disclosure of which is incorporated herein in its entirety by reference.

BACKGROUND

1. Field of the General Inventive Concept

The present general inventive concept relates to a developing device and an image forming apparatus including the same.

2. Description of the Related Art

Electrophotographic image forming apparatuses print an image on a recording medium by irradiating light that is modulated to correspond to image information, onto a photoconductor in order to form an electrostatic latent image on a surface of the photoconductor, supplying toner to the electrostatic latent image in order to develop the electrostatic latent image into a visible toner image, and transferring and fixing the toner image to the recording medium. The electrophotographic image forming apparatus includes a developing device containing toner.

The photoconductor and the toner may be provided in the form of a cartridge, which is referred to as a "developing device". When the toner contained in the developing device is completely consumed, the developing device is detached from the electrophotographic image forming apparatus, and a new developing device is mounted in the electrophotographic image forming apparatus.

The developing device may include a toner retaining unit and a developing unit. The toner retaining unit and the developing unit are separated from each other by an isolation film until they are mounted in the electrophotographic image forming apparatus. Before being mounted in the electrophotographic image forming apparatus, the toner retaining unit and the developing unit are connected to each other by removing the isolation film. When the isolation film is removed, unless the developing device is properly assembled, toner can leak out of the developing device.

SUMMARY

The present general inventive concept provides a developing device which prevents toner in the developing device from being leaked to the outside, and an image forming apparatus including the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a developing device including a housing containing toner and having an opening at a side thereof, a developing roller supplying the toner supplied through the opening to a photoconductive drum, and a regulator contacting the outer circumference of the developing roller to regulate the amount of the toner supplied to the photoconductive drum, the housing including a lower frame having side portions and a lower end portion to respectively form both edges and a lower edge of the opening in a lengthwise direction, and an upper frame welded and coupled to the lower frame and including a leading end portion to form an upper edge of the opening and a recess portion recessed from the leading end portion at both end portions of the leading end portion in the lengthwise direction, wherein both side portions of the lower frame includes a first surface to contact the recess portion to prevent the upper frame from being pushed toward the developing roller when the upper frame is welded and coupled to the lower frame.

The regulator may include a support portion coupled to the housing, and a blade portion extending downwardly from the support portion and having an end portion contacting the outer circumference of the developing roller in the lengthwise direction.

The developing device may further include a first upper sealing member provided at the leading end portion in the lengthwise direction and contacting an inner surface of the blade portion to prevent leakage of toner through an upper edge of the opening. The developing device may further include a first side sealing member provided on a surface of both side portions of the lower frame, the surface facing the developing roller, and contacting the outer circumference of the developing roller and the inner surface of the blade portion to prevent leakage of the toner through both side edges of the opening, and a lower sealing member located at a lower end portion of the lower frame and contacting the outer circumference of the developing roller to prevent leakage of the toner through a lower edge of the opening.

The first upper sealing member may be attached to the leading end portion using a double-sided adhesive tape, a first side sealing member may be provided on a surface of both side portions of the lower frame, the surface facing the developing roller, and contacts the outer circumference of the developing roller and the inner surface of the blade portion to prevent leakage of the toner through both side edges of the opening, and a second upper sealing member overlapping both end portions of the first upper sealing member and the first side sealing member may be provided on the inner surface of the blade portion in the lengthwise direction.

The first upper sealing member may be a foam elastic member that is coated in a liquid state on the leading end portion and foamed thereon. The foam elastic member may include a first sealing portion located at the leading end portion, and a second sealing portion filling a gap between each of both side portions of the lower frame and each of both end portions of the leading end portion in the lengthwise direction, wherein the foam elastic member substantially has an "H" shape. The upper frame may include a blocking rib located between each of both side portions of the lower frame and each of both end portions of the leading end portion and blocking the foam elastic member in a liquid state coated to form the second sealing portion from intruding inside the leading end portion. The interval between each of both side portions and the blocking rib may be 0.7 mm-1.5 mm.

A second side sealing member may be provided at each of both end portions of the blade portion in the lengthwise direction, overlapping the first upper sealing member and the first side sealing member provided on a surface of both side portions of the lower frame, to prevent leakage of the toner between the first upper sealing member and the side sealing member.

The leading end portion may have an "L" shape to support the upper sealing member not to be pushed down by the regulator.

A welding thread and a welding root surrounding a toner accommodation space except for the opening that may be respectively provided at the upper frame and the lower frame, and at least a part of the welding thread and the welding root may be inclined in a vertical direction.

According to another aspect of the present general inventive concept, there is provided an electrophotographic image forming apparatus include the developing device, an optical scanning unit scanning light modulated according to an image signal, onto the photoconductive drum, a transfer unit transferring a toner image formed on the photoconductive drum to a recording medium, and a fixing unit fixing the toner image by applying heat and pressure to the recording medium.

The regulator may include a support portion coupled to the housing, a blade portion extending downwardly from the support portion and having an end portion to contact an outer circumference of the developing roller in a lengthwise direction, wherein the developing device may include a first upper sealing member provided at the leading end portion in the lengthwise direction and contacting an inner surface of the blade portion to prevent leakage of toner through the upper edge of the opening.

The first upper sealing member may be attached to the leading end portion using a double-sided adhesive tape, a first side sealing member may be provided on a surface of both side portions of the lower frame, the surface facing the developing roller, and may contact the outer circumference of the developing roller and the inner surface of the blade portion to prevent leakage of the toner through both side edges of the opening, and a second upper sealing member to overlap both end portions of the first upper sealing member and the first side sealing member may be provided on the inner surface of the blade portion in the lengthwise direction.

The first upper sealing member may be a foam elastic member that is coated in a liquid state on the leading end portion and foamed thereon.

The foam elastic member may include a first sealing portion located at the leading end portion, and a second sealing portion filling a gap between each of both side portions of the lower frame and each of both end portions of the leading end portion in the lengthwise direction, wherein the foam elastic member substantially may have an "H" shape.

The image forming apparatus may also include a first side sealing member provided on a surface of both side portions of the lower frame, the surface facing the developing roller, and may contact the outer circumference of the developing roller and the inner surface of the blade portion to prevent leakage of the toner through both side edges of the opening, a lower sealing member located at a lower end portion of the lower frame and contacting the outer circumference of the developing roller to prevent leakage of the toner through a lower edge of the opening, and a second side sealing member provided at each of both end portions of the blade portion in the lengthwise direction, overlapping the first upper sealing member and the first side sealing member, to prevent leakage of the toner between the first upper sealing member and the side sealing member.

The leading end portion may have an "L" shape.

A welding thread and a welding root surrounding a toner accommodation space except for the opening may be respectively provided at the upper frame and the lower frame, and at least a part of the welding thread and the welding root may be inclined in a vertical direction.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE EMBODIMENTS

Figure 1:
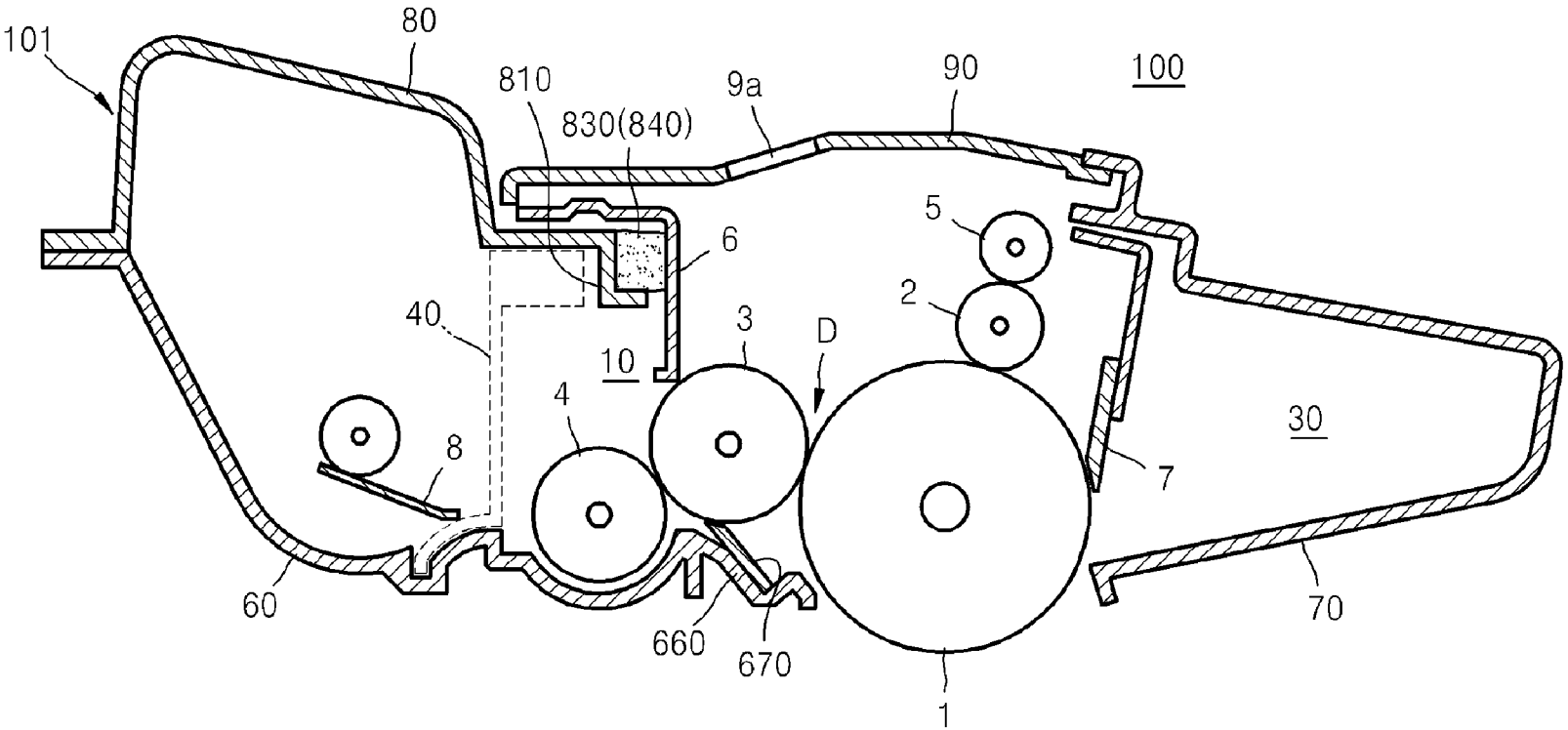
FIG. 1 is a schematic view illustrating the configuration of a developing device according to an embodiment of the present general inventive concept.

An image forming apparatus and a developing device according to the present general inventive concept will now be described more fully with reference to the accompanying drawings, in which exemplary embodiments of the present general inventive concept are illustrated.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
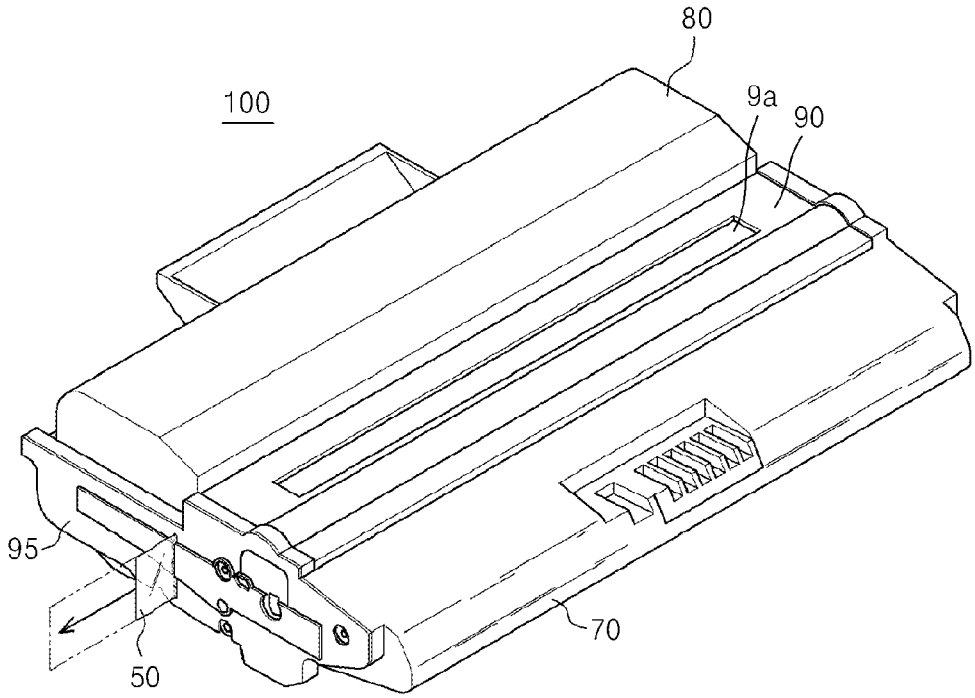
FIG. 2 is a perspective view illustrating the developing device of FIG. 1.

FIG. 1 is a schematic view illustrating the configuration of a developing device 100 according to an embodiment of the present general inventive concept. FIG. 2 is a perspective view illustrating the developing device 100 of FIG. 1. Referring to FIGS. 1 and 2, the developing device 100 includes a housing 101 containing toner. An opening 10 is provided in the housing 101. Toner is supplied to a developing roller 3 through the opening 10.

The developing device 100 of the present general inventive concept also includes a photoconductive drum 1 and a charging roller 2. The photoconductive drum 1 includes a photoconductive layer exhibiting photoconductivity and formed around an outer circumference of a cylindrical metal pipe. The charging roller 2 is an example of a charger that charges the surface of the photoconductive drum 1 to a uniform electric potential. A charging bias voltage is applied to the charging roller 2. A corona charger (not illustrated) may be used instead of the charging roller 2. The developing roller 3 supplies the toner supplied through an opening 10 to an electrostatic latent image formed on the surface of the photoconductive drum 1 to develop the electrostatic latent image.

In the present embodiment, a contact developing technique in which the developing roller 3 and the photoconductive drum 1 contact each other, thereby forming a development nip D is employed. In this case, the developing roller 3 may include an elastic layer (not illustrated) formed around an outer circumference of a conductive metal core (not illustrated). When a developing bias voltage is applied to the developing roller 3, the toner is transferred via the development nip D to the electrostatic latent image on the surface of the photoconductive drum 1 and attached thereto. A non-contact method may also be employed, in which the surface of the developing roller 3 and the surface of the photoconductive drum 1 are separated from each other at an interval of several hundreds of microns. In this method, the difference of the electric potentials between the developing roller 3 and the photoconductive drum 1 and a charge or polarity of the toner may cause the toner to be attracted from the developing roller 3 to the photoconductive drum 1.

The developing device 100 may further include a supply roller 4 to attach the toner supplied through the opening 10 to the developing roller 3. A supply bias voltage may be applied to the supply roller 4 in order to attach the toner to the developing roller 3. A cleaning roller 5 removes foreign materials and the toner attached to the charging roller 2. A regulator 6 regulates the amount of toner attached to a surface of the developing roller 3 and supplied to the development nip D. A cleaning member 7 removes the remaining toner and the foreign materials from the surface of the photoconductive drum 1 prior to charging. The remaining toner and the foreign materials removed from the surface of the photoconductive drum 1 by the cleaning member 7 are accommodated and accumulated in a waste toner retaining unit 30.

The housing 101 may include an agitator 8 to supply the toner to the developing roller 3. The agitator 8 may agitate the toner contained in the housing 101 to frictionally charge the toner to a predetermined electric potential. Although FIG. 1 illustrates only one agitator, the scope of the present general inventive concept is not limited thereto. Considering the volume or shape of the housing 101, an appropriate number of agitators may be installed at appropriate positions in the housing 101 to effectively supply the toner to the developing roller 3.

Referring to FIGS. 1 and 2, the housing 101 includes a lower frame 60 and an upper frame 80. The lower frame 60 includes side portions and a lower end portion 660 forming both sides and a lower side of the opening 10 in a lengthwise direction of the opening 10. The upper frame 80 includes a leading end portion 810 forming the upper edge of the opening 10.

The developing device 100 may further include a retaining frame 70 forming the waste toner retaining unit 30. The lower frame 60 and the retaining frame 70 are connected to each other by a side frame 95. The cover 90 covers the upper portion of the lower frame 60 and the retaining frame 70 connected to each other and a portion of the cover 90 is positioned above the leading end portion 810. The developing device 100 configured as above is an integrated developing device including the developing roller 3 and the photoconductive drum 1. The cover 90 includes a window **9*a* to allow light emitted from an optical scanning unit 200 of FIG. 12** that is described later to pass therethrough.

As an applied example, the retaining frame 70 to which the photoconductive drum 1, the charging roller 2, the cleaning roller 5, and the cleaning member 7 are coupled may be separately installed in the image forming device in the form of a photoconductive drum cartridge.

Figure 3:
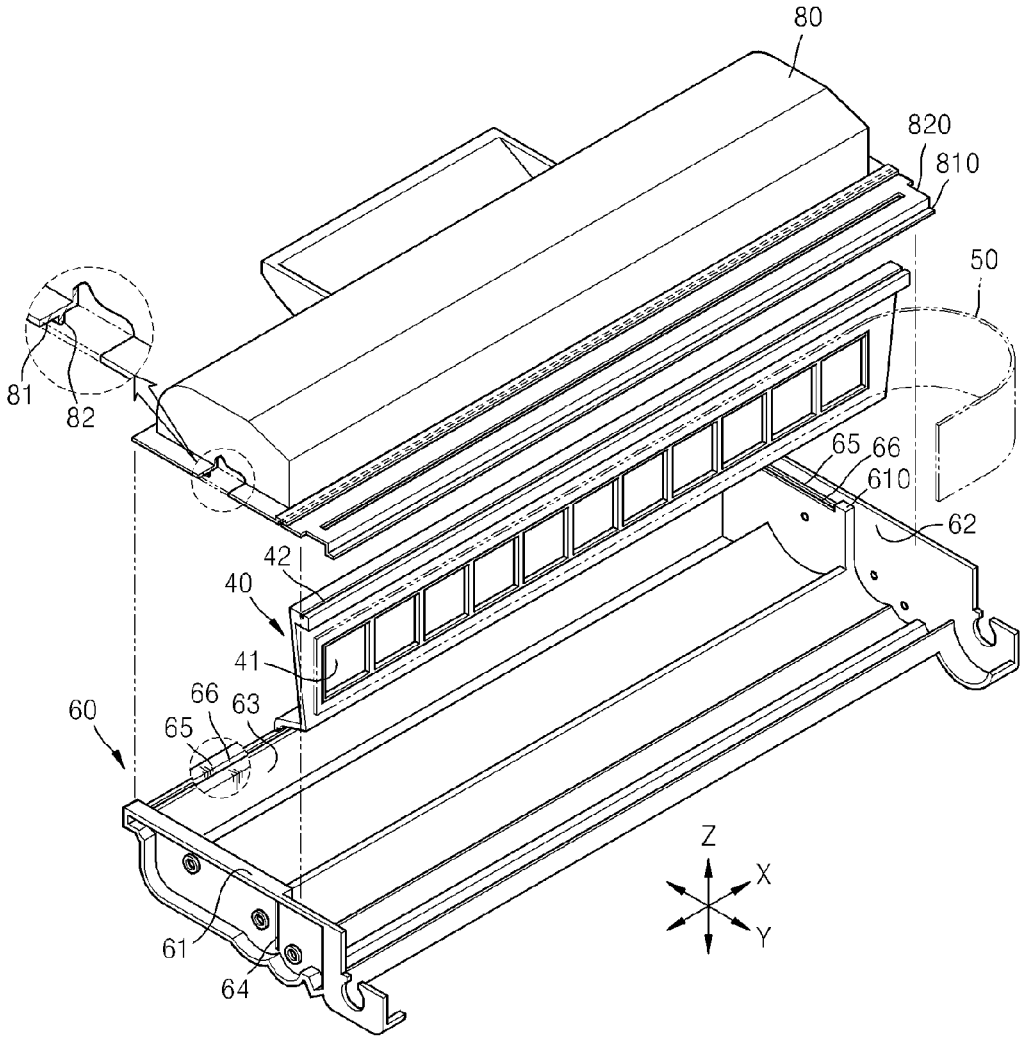
FIG. 3 is an exploded perspective view illustrating the coupling relationship between a lower frame, a partition member, and an upper frame according to an embodiment of the present general inventive concept.

FIG. 3 is an exploded perspective view illustrating the coupling relationship between the lower frame 60, a partition member 40, and the upper frame 80. Referring to FIG. 3, the developing device 100 may further include the partition member 40 having a plurality of toner supply windows 41. An isolation film 50 blocking the toner supply windows 41 is attached to the partition member 40. The toner is contained in a space formed by the partition member 40, the upper frame 80, and the lower frame 60. An end portion of the isolation film 50 exposed to a side portion of the developing device 100 as illustrated in FIG. 2 may be pulled out to separate or remove the isolation film 50 from the partition member 40 before the developing device 100 is installed in the image forming device. When the isolation film 50 is completely removed, the opening 10 is opened. That is, the opening 10 is provided as a path of the toner through the toner supply windows 41. The partition member 40 may be a plate formed with portions to define the corresponding windows 41.

Before being removed, the isolation film 50 is attached to the partition member 40 and the partition member 40 with the isolation film 50 attached thereto is coupled to the lower frame 60. The partition member 40 may be coupled to the lower frame 60 by an ultrasonic wave welding process. An eject slot 64 is provided at a side wall 61 of the lower frame 60. An end portion of the isolation film 50 is exposed to an outside environment through the eject slot 64.

The upper frame 80 may be coupled to the lower frame 60 by a welding method, for example, an ultrasonic wave welding method. When the partition member 40 is provided, the lower surface of the leading end portion 810 of the upper frame 80 may be welded and coupled to an upper surface 42 of the partition member 40.

In FIG. 3, a first accommodation surface 65 surrounding an area except for an area where the opening 10 is located is provided at the lower frame 60. A welding root 66 is recessed from the first accommodation surface 65. A second accommodation surface 81 and a welding thread 82 respectively corresponding to the first accommodation surface 65 and the welding root 66 are provided at the upper frame 80. The welding thread 82 and the welding root 66 may be respectively formed to connect the first accommodation surface 65 to the second accommodation surface 81.

The first accommodation surface 65 and welding root 66 may be disposed on both side walls 61 and on a back wall 63 of the lower frame 60. The second accommodation surface 81 and the wiring thread 82 may be disposed on the two side surfaces and back surface of the upper frame 80 to respectively correspond to the first accommodation surface 65 and the welding root 66.

Figure 4:
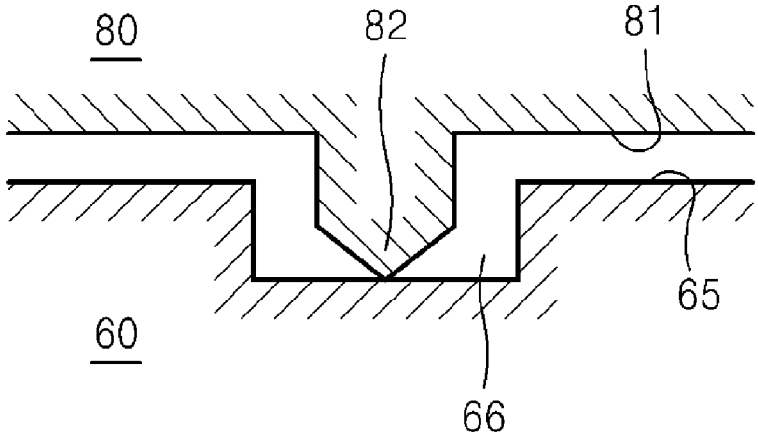
FIG. 4 is a cross-sectional view illustrating a welding thread and a welding root according to an embodiment of the present general inventive concept.
Figure 5:
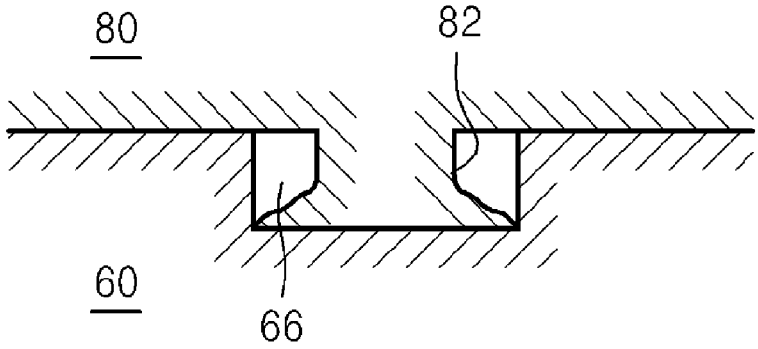
FIG. 5 is a cross-sectional view illustrating the welding thread and the welding root that are welded and combined to each other according to an embodiment of the present general inventive concept.

As illustrated in FIG. 4, the upper frame 80 is placed on the lower frame 60 to insert the welding thread 82 of the second accommodation layer 81 into the welding root or groove 66 of the first accommodation layer 65, and then, ultrasonic wave energy is supplied while pressing the upper frame 80 using a welding jig (not illustrated). The ultrasonic wave energy generates vibrations at a portion where the welding thread 82 contacts the welding root 66 at a bottom and side surfaces thereof. The welding thread 82 is welded due to the vibrations and then solidified and spread out within the root, thereby being attached to the welding root 66 and connecting the first accommodation layer 65 to the second accommodation layer 82 as illustrated in FIG. 5. Accordingly, the upper frame 80 is welded and coupled to the lower frame 60.

Referring to FIG. 4, when the upper frame 80 is welded and coupled to the lower frame 60, the welding thread 82 needs to be accurately inserted in the welding root 66. Otherwise, the ultrasonic wave energy may not be properly transferred to the welding thread 82 and the welding root 66 resulting that defective welding may be generated. When this happens, a gap may be generated between the welding thread 82 and the welding root 66 that may allow toner to leak through the gap.

As illustrated in FIG. 3, the side walls 61 and 62 extend widthwise in a front-to-rear Y direction and the back wall 63 extends lengthwise in a left-to-right X direction. As stated above, both of the side walls 61, 62 and the back wall 63 of the lower frame 60 include a first accommodation surface 65 with a welding root 66 that correspond to a second accommodation surface 81 and a welding thread 82 of the upper frame 80.

The front-to-rear positional deviation, that is, a deviation in a Y-direction of FIG. 3, of the upper frame 80 has a greater influence on the sealing of toner than a left-to-right positional deviation, that is, a deviation in an X-direction of FIG. 3. This is because the welding thread 82 and the welding root 66 in the X direction may rarely be designed and manufactured with an incline in the vertical direction Z, whereas the portions of the welding thread 82 and the welding root 66 that extend in the Y direction may be manufactured by being inclined in the vertical direction Z. That is, since the shapes of the side portions of the lower frame 60 and the upper frame 80 may be made very complicated in order to accommodate a variety of parts, at least a part of the welding root 66 provided at the side walls 61 and 62 may be inclined in the vertical direction Z. Also, the welding thread 82 of the upper frame 80 corresponding to the welding root 66 may be formed to be inclined in the vertical direction Z.

Figure 6A:
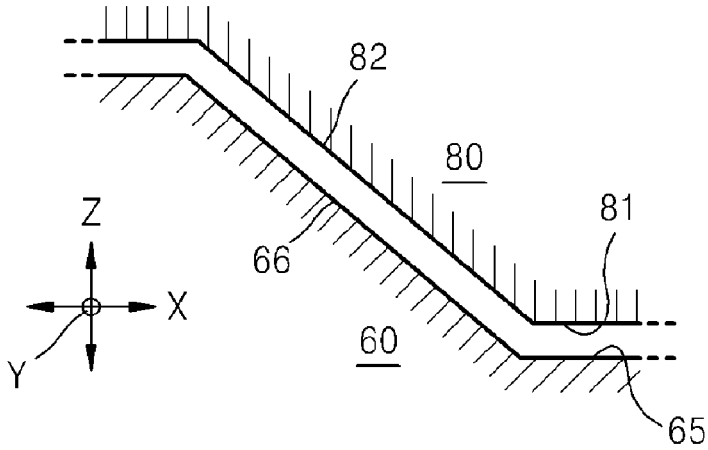
FIGS. 6A-6D are cross-sectional views illustrating welding threads and a welding roots that are inclined according to an embodiment of the present general inventive concept.
Figure 6B:
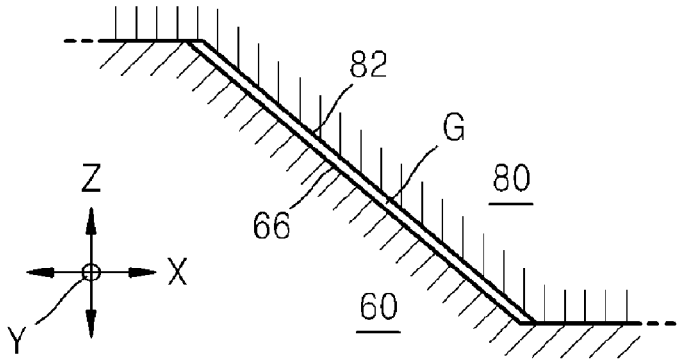
Figure 6C:
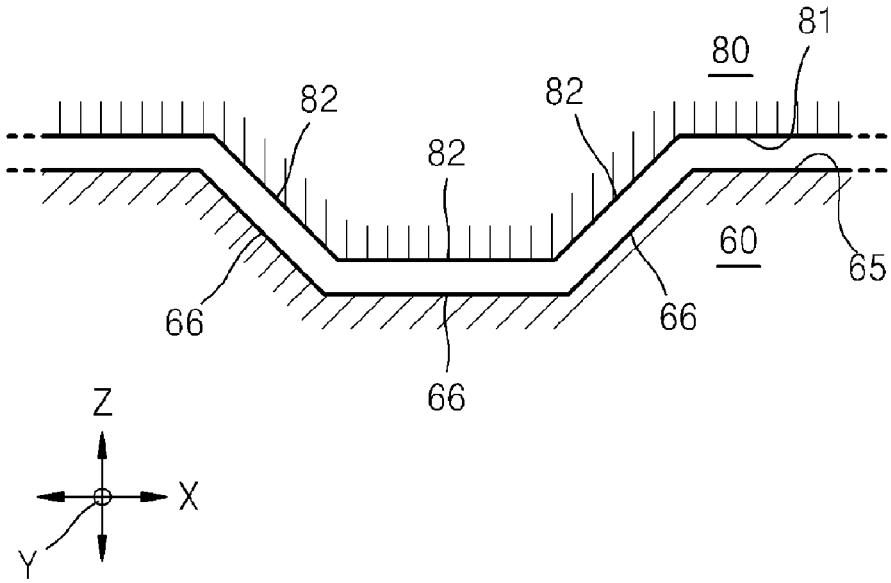

Example embodiments of the side portions of the lower frame 60 and upper frame 80 having complication shapes are illustrated in FIGS. 6A-6D. FIGS. 6A and 6C illustrate different configurations in which the first accommodation layer 65 and second accommodation layer 81 have irregular shapes in which to connect the lower frame 60 to the upper frame 80. As illustrated, the welding thread 82 and welding root 66 are provided to be inclined the vertical Z direction. FIG. 6C also may include a horizontal portion to the welding thread and root section. When looking into the page as illustrated in FIGS. 6A and 6B, the inclined welding thread and welding root extend in the Y direction, along the sides of the side walls 61 of the lower frame 60 and along the side portions of the upper frame 80.

Figure 6D:
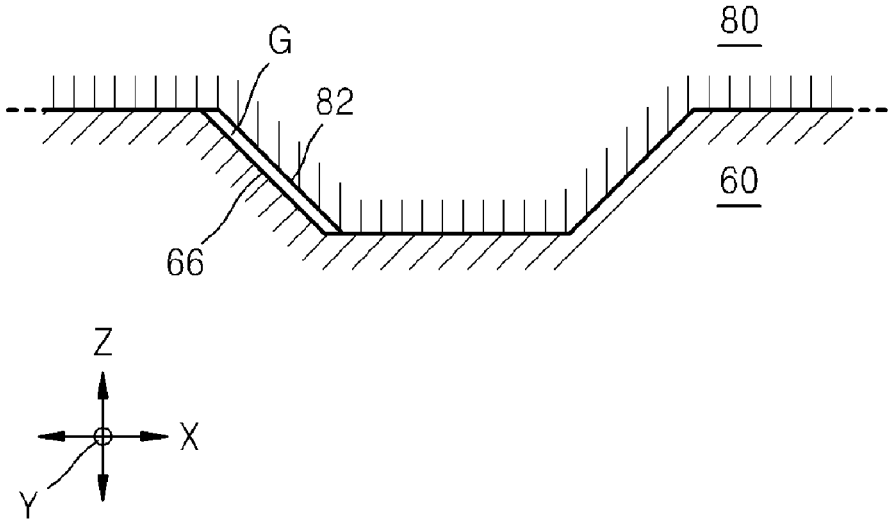

When an assembly position deviation in the X direction of the upper frame 80 is generated, as illustrated in FIGS. 6B and 6D, a gap G may be generated between the welding thread 82 and the welding root 66. The gap G may be generated over the entire length in the Y direction, in and out of the page, of the welding thread 82 and the welding root 66 that are inclined. In this state, when the welding jig supplying ultrasonic wave energy presses the upper frame 80 in the vertical direction Z, since the welding thread 82 and the welding root 66 do not contact each other, the welding thread 82 is not welded or is incompletely welded so that defective welding is generated.

Figure 7:
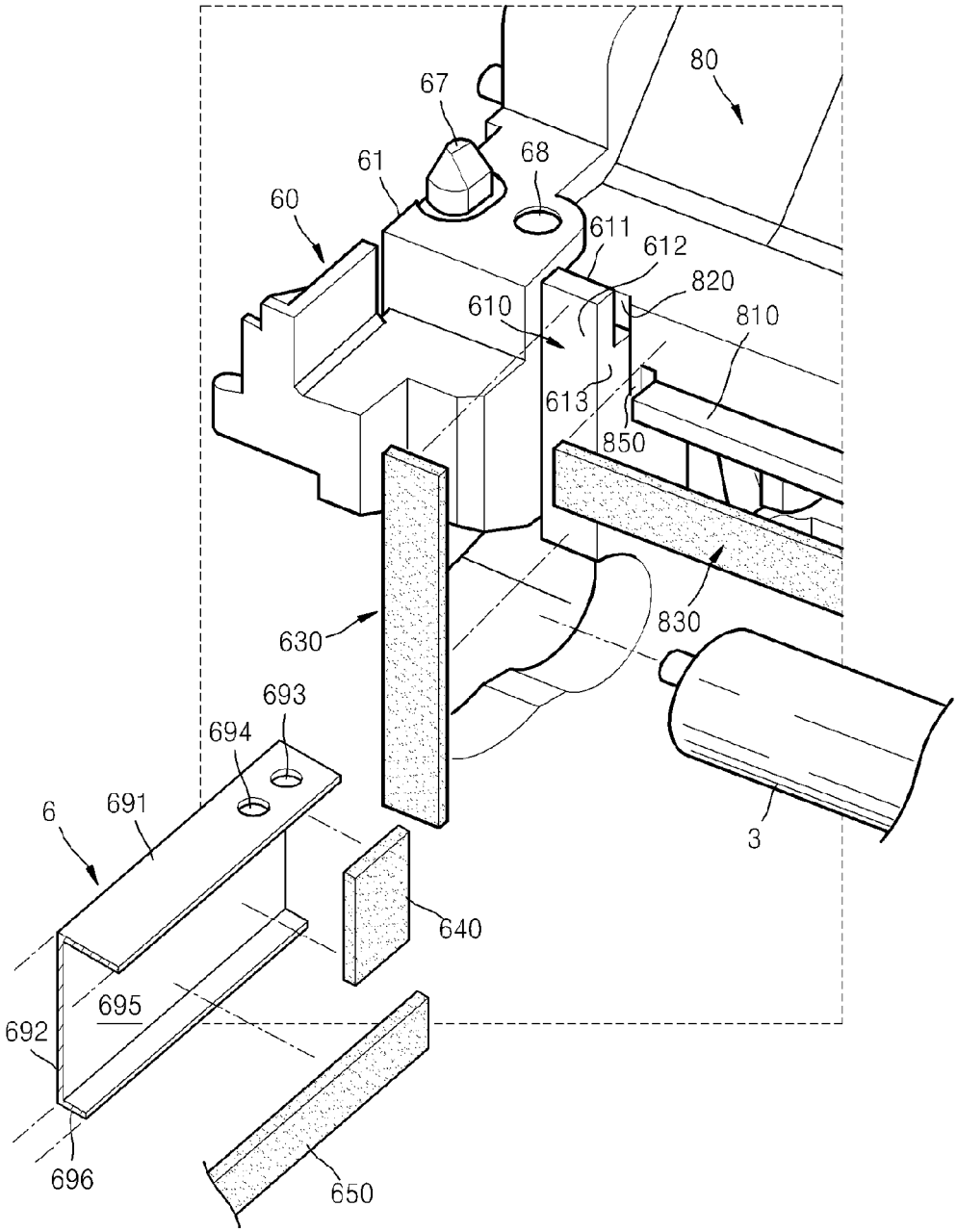
FIG. 7 is a partially exploded perspective view illustrating the coupling relationship between a housing, a regulator, a developing roller, and a sealing member according to an embodiment of the present general inventive concept.

Thus, there is a need to limit the displacement of the assembly position of the upper frame 80 in the Y direction. Referring to FIGS. 3 and 7, a recess portion 820 recessed from the leading end portion 810 of the upper frame 80 in the opposite direction to the developing roller 3 is provided at both end portions of the leading end portion 810. The side portion 610 inwardly protrudes from the side wall 61 of the lower frame 60. A first surface 611 contacting the recess portion 820 is provided at the side portion 610. The first surface 611 upwardly protrudes at least higher than the first accommodation surface 65 of FIG. 3. The recess portion 820 of the upper frame 80 contacts and borders the first surface 611. Although not illustrated in FIG. 7, the first surface 611 is also provided at the side portion 610 of the side wall 62. Accordingly, the assembly position of the upper frame 80 in the Y direction is limited by the first surface 611 and the recess portion 820 so that the upper frame 80 is not pushed toward the developing roller 3 during the ultrasonic wave welding process. Thus, defective welding due to assembly deviation of the upper frame 80 in the Y direction and the leakage of toner may be prevented.

Figure 8:
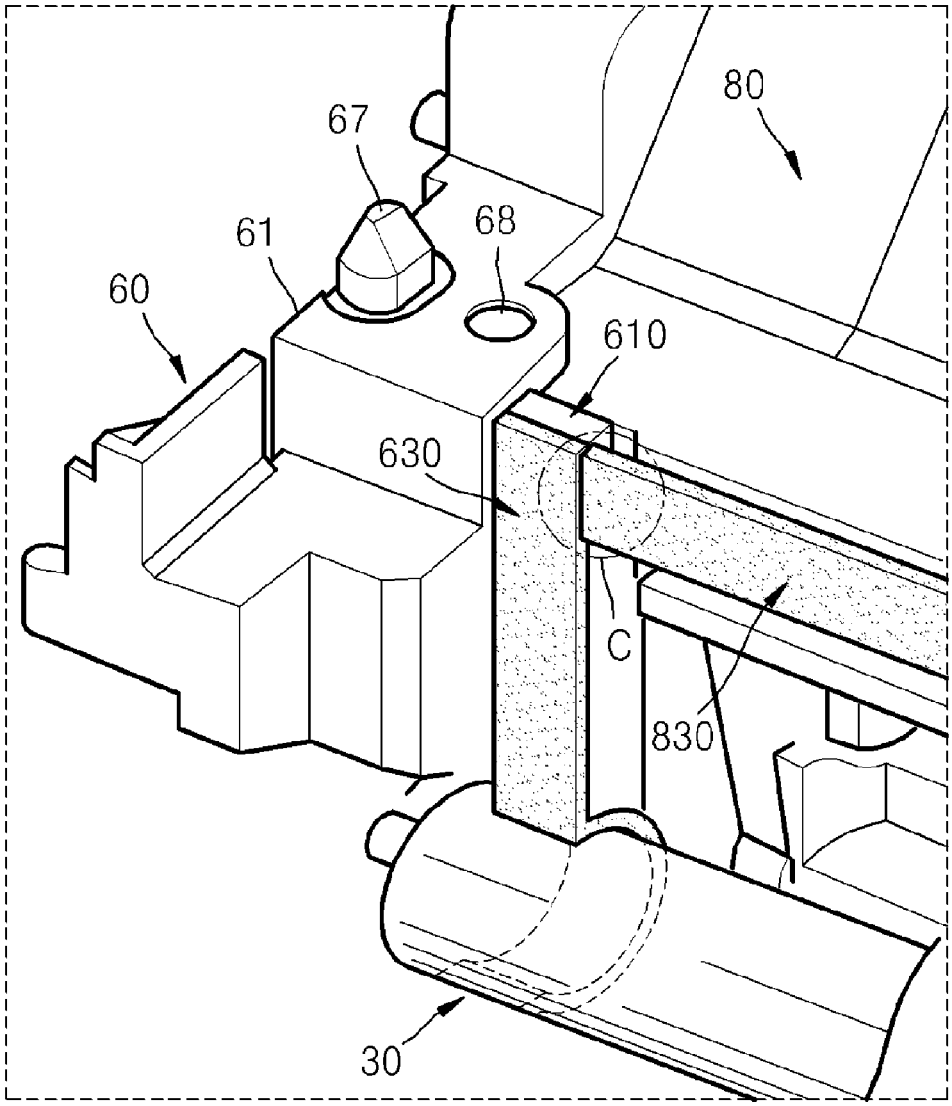
FIG. 8 is a perspective view illustrating that an attachable sealing member is employed as an upper sealing member according to an embodiment of the present general inventive concept.

As illustrated in FIGS. 7 and 8, a first side sealing member 630 is attached to a surface of the side portion 610 close to the developing roller 3, that is, a second surface 612 that is the opposite to the first surface 611. The first side sealing member 630 may be manufactured of sponge or felt. The first side sealing member 630 may be attached to the second surface 612 of the side portion 610 using a double-sided adhesive tape.

A first upper sealing member is assembled to the leading end portion 810 of the upper frame 80. The first upper sealing member may be an attachable sealing member 830 that is manufactured of sponge and attached to the leading end portion 810 using the double-sided adhesive tape. The attachable sealing member 830 is attached to the leading end portion 810 such that both end portions thereof may contact or overlap both side sealing members 630 to prevent generation of a gap between the first side sealing member 630 and the attachable sealing member 830.

Figure 9:
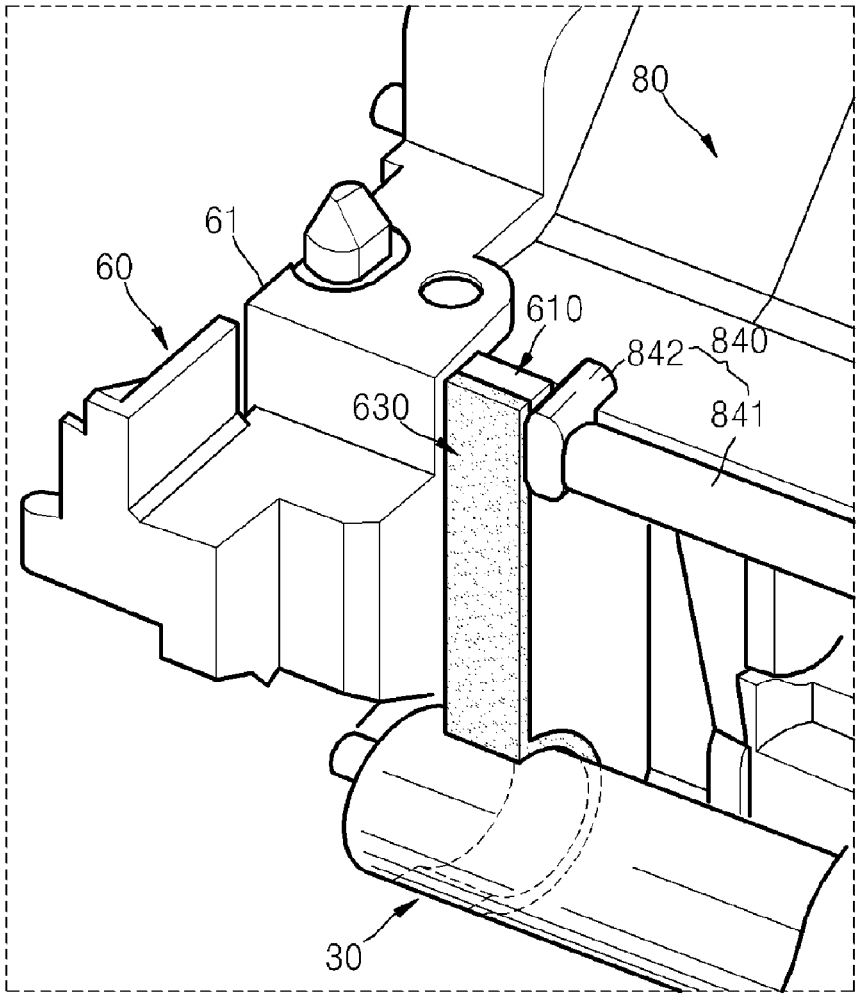
FIG. 9 is a perspective view illustrating that a foamed elastic member is employed as the upper sealing member according to an embodiment of the present general inventive concept.

A foam type sealing member may be used as the first upper sealing member instead of the attachable sealing member 830. Referring to FIG. 9, a foam elastic member 840 may be coated on the leading end portion 810 of the upper frame 80. The foam elastic member 840 that is liquid is instantly foamed as soon as being coated and then solidified and formed into an elastic body. The foam elastic member 840 may be, for example, urethane. Referring to FIG. 7, a third surface 613 of the side portion 610 close to the leading end portion 810 and both end portions of the leading end portion 810 are separated from each other so that a foam liquid may easily intrude therebetween and be formed therein. Thus, the foam elastic member 840 includes a first sealing portion 841 formed along the leading end portion 810 and a second sealing portion 842 vertically extending between both end portions of the leading end portion 810 and the third surface 613 of the side portion 610, thereby having a long "H" shape between the side walls 61 and 62. Referring to FIG. 7, a blocking rib 850 is provided at both end portions of the leading end portion 810. The blocking rib 850 blocks the foam liquid from intruding inside the developing device via both end portions of the leading end portion 810. To allow the foam liquid to intrude between the blocking rib 850 and the third surface 613 of the side portion 610, the interval between the blocking rib 850 and the third surface 613 of the side portion 610 may be set to be, for example, 0.7 mm-1.5 mm. Thus, by employing the foam elastic member 840 as the first upper sealing member, an automated foam liquid supply apparatus may be used in a manufacturing process of the developing device 100 so that a sealing process may be automated.

Next, a regulator 6 is coupled to the lower frame 60. The regulator 6 may include a support portion 691 coupled to the lower frame 60 and a blade portion 692 extending downwardly from the support portion 691 and having an end portion 696 contacting the outer circumference of the developing roller 3 in the lengthwise direction. The support portion 691 further includes a position determination hole 693 and a fixing hole 694. The lower frame 60 includes a position determination boss or protrusion 67 inserted in the position determination hole 693, and a coupling hole 68 which is connected to the fixing hole 694 and to which a coupling member such as a screw (not illustrated) is coupled.

The regulator 6 is coupled to the lower frame 60 and the developing roller 3 is coupled to the lower frame 60. The end portion 696 of the blade portion 692 contacts the outer circumference of the developing roller 3. The first upper sealing member, for example, the attachable sealing member 830 or the foam elastic member 840, contacts an inner surface 695 of the blade portion 692. Accordingly, as illustrated in FIG. 10, toner leakage through the leading end portion 810, that is, an upper edge of the opening 10, may be prevented.

Figure 10:
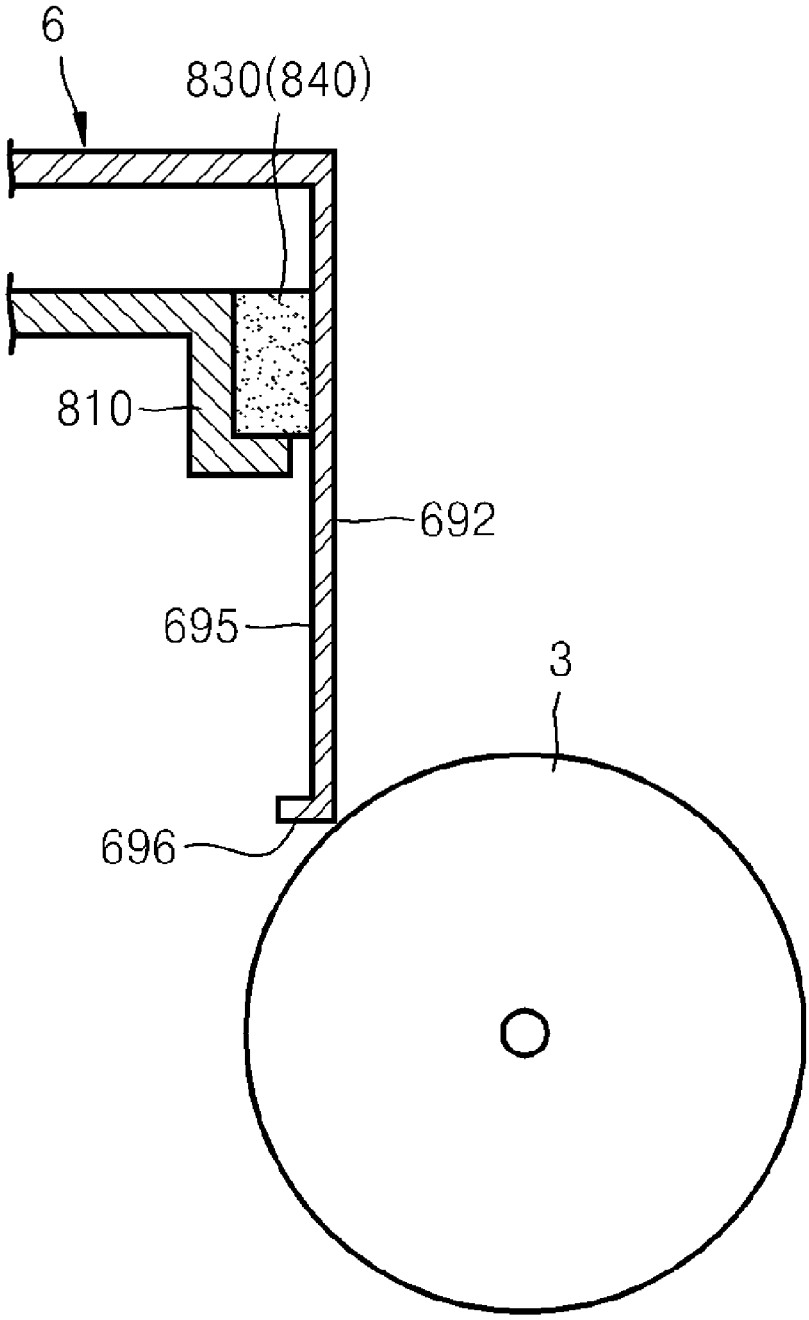
FIG. 10 is a partially cross-sectional view illustrating that an upper edge of an opening is sealed by using the upper sealing member according to an embodiment of the present general inventive concept.

Referring to FIGS. 7 and 10, the leading end portion 810 of the upper frame 80 may have an "L" shape. After the first upper sealing member 830 or 840 is installed on the leading end portion 810, the regulator 6 is assembled to the lower frame 60. As the blade portion 692 contacts the first upper sealing member 830 or 840, the first upper sealing member 830 or 840 may be pushed down so as to be deviated from an attachment position or separated from the leading end portion 810. However, the leading end portion 810 having the "L" shape supports the first upper sealing member 830 or 840 to prevent the first upper sealing member from being deviated from the attachment position or separated from the leading end portion 810 due to the interference with the regulator 6. When the foam liquid is coated on the leading end portion 810 to form the foam elastic member 840, the leading end portion 810 having the "L" shape blocks the foam liquid from flowing down and contaminating the inside of the developing device 100.

Also, when the regulator 6 is assembled, the force of assembly may cause the first upper sealing member to compress which may allow the leading end portion 810 to become flush with the inner surface 695 of the regulator 6, or with a small portion of the first upper sealing member wedged in between. Such a configuration also prevents leakage of the toner.

Figure 11:
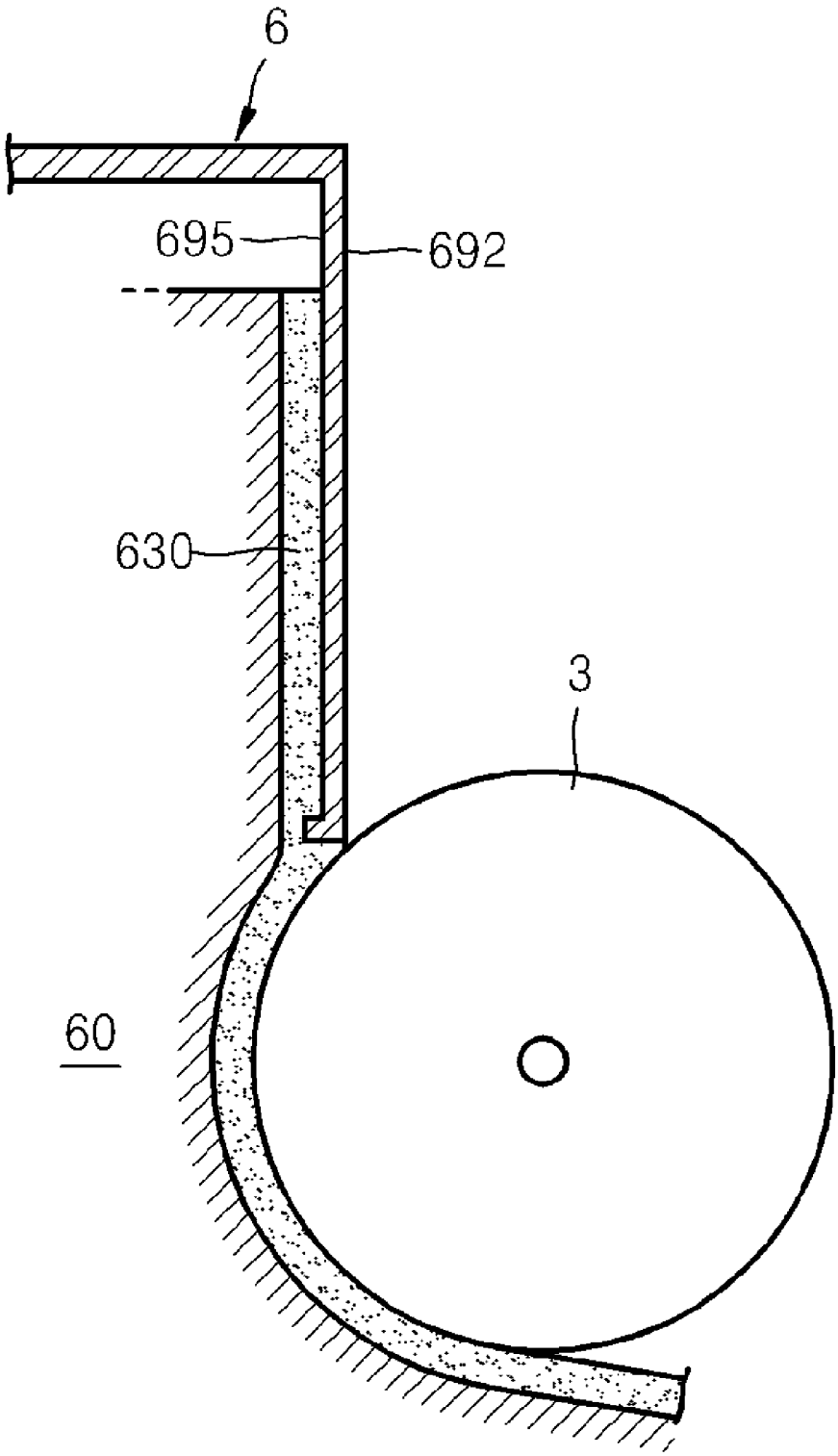
FIG. 11 is a partially cross-sectional view illustrating that a lateral edge of the opening is sealed by using the lateral sealing member according to an embodiment of the present general inventive concept.

As illustrated in FIG. 11, while one surface of the first side sealing member 630 may contact the outer circumference of the developing roller 3 and the inner surface 695 of the blade portion 692, the other surface of the first side sealing member 630 may contact the lower frame 60. Thus, toner leakage through the side edge of the opening 10 may be blocked when installing the developing device 100 or operating an image forming apparatus using the developing device 100.

As illustrated in FIG. 7, second side sealing members 640 may be further provided at both end portions of the blade portion 692 in the lengthwise direction thereof. The second side sealing members 640 may be manufactured of, for example, sponge or felt, and attached to the inner surface 695 of the blade portion 692. The second side sealing members 640 contact the first side sealing members 630 to improve a sealing effect of the first side sealing members 630. In addition, the second side sealing members 640 overlap the first side sealing member 630 and both end portions of the first upper sealing member 830 or 840 so that a sealing effect in an area C of FIG. 8 where the first side sealing member 630 and both end portions of the first upper sealing member 830 or 840 meet may be improved. Thus, when the developing device 100 is used by being installed in the image forming apparatus, the toner is forcibly transferred toward the developing roller 3 by an agitator 8. A toner transfer pressure may concentrate at the portion C where the first side sealing member 630 and both end portions of the first upper sealing member 830 or 840 meet. Thus, the second side sealing member 640 may block the leakage of toner that may be generated as the first side sealing member 630 and both end portions of the first upper sealing member 830 or 840 are separated from each other due to the toner transfer pressure.

As illustrated in FIG. 7, a second upper sealing member 650 is further provided at the blade portion 692. The second upper sealing member 650 that extends in the lengthwise direction may be manufactured of, for example, sponge or felt, and attached to the inner surface 695 of the blade portion 692 using a double-sided adhesive tape. Both end portions of the second upper sealing member 650 may overlap the second side sealing member 640. The second upper sealing member 650 may contact the first upper sealing member to improve a sealing effect. The second upper sealing member 650 may improve the sealing effect when the attachable sealing member 830 exhibiting elasticity lower than that of the foam elastic member 840 is employed as the first upper sealing member. Also, when the foam elastic member 840 is employed, the second upper sealing member 650 may be employed to improve the sealing effect.

Referring to FIG. 1, a lower sealing member 670 is provided at a lower end portion 660 of the lower frame 60. The lower sealing member 670 may be a film member exhibiting elasticity. The lower sealing member 670 contacts the outer circumference of the developing roller 3 in the lengthwise direction thereof. Consequently, after the isolation film 50 is removed, the leakage of toner through the lower edge of the opening 10 may be prevented when the developing device 100 is installed or during operation of an image forming apparatus using the developing device 100.

Figure 12:
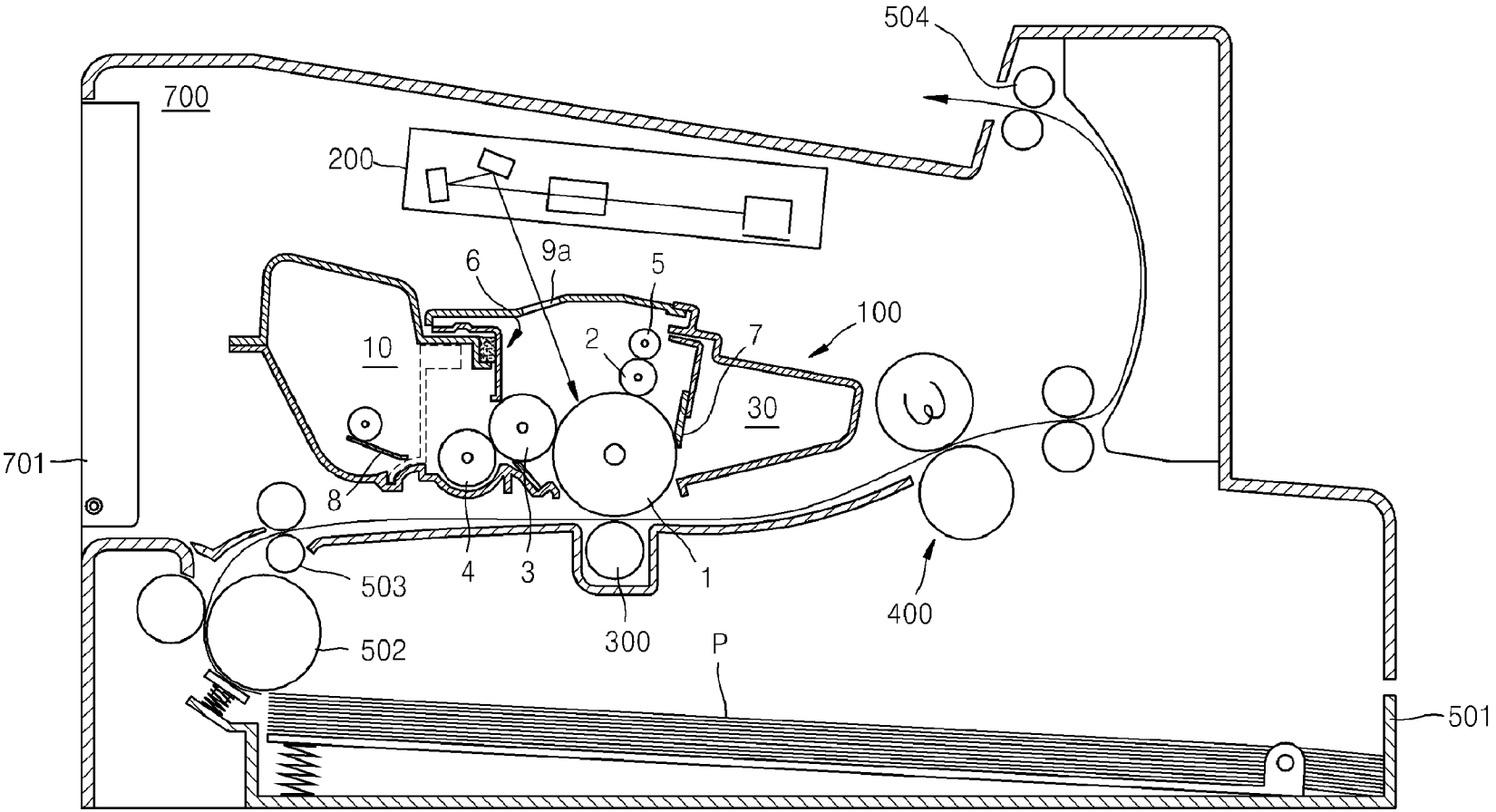
FIG. 12 is a schematic view illustrating the configuration of an image forming apparatus according to an embodiment of the present general inventive concept.

FIG. 12 is a schematic view illustrating the configuration of the image forming apparatus illustrated in FIGS. 1-11. Referring to FIG. 12, the developing device 100 is installed at a main body 700 of the image forming apparatus through a door 701. In the developing device 100 having the partition member 40, the isolation film 50 is removed before the developing device 100 is installed in the main body 700.

The optical scanning unit 200 scans light that is modulated according to image information, onto the photoconductive drum 1 that is charged to a uniform potential. For example, a laser scanning unit (LSU) that scans light emitted from a laser diode onto the photoconductive drum 1 by deflecting the light in a main scanning direction by using a polygon mirror may be used as the optical scanning unit 200.

A transfer roller 300, which is an example of a transfer unit, is located to face the surface of the photoconductive drum 1, and forms a transfer nip. A transfer bias voltage is applied to the transfer roller 300 so as to transfer a toner image developed on the surface of the photoconductive drum 1 to a recording medium P. A corona transfer unit may be used instead of the transfer roller 300.

The toner image transferred to the surface of the recording medium P by the transfer roller 300 remains adhered to the surface of the recording medium P due to electrostatic attraction. A fixing unit 400 applies heat and pressure to fix the toner image to the recording medium P, thereby forming a permanent printed image on the recording medium P.

An image forming process by the image forming apparatus configured as above will now be briefly described. When a charging bias voltage is applied to the charging roller 2, the photoconductive drum 1 is charged to a uniform potential. The optical scanning unit 200 scans light that is modulated according to image information, onto the photoconductive drum 1 through the window 9*a* of the developing device 100, thereby forming an electrostatic latent image on the surface of the photoconductive drum 1. The agitator transfers the toner to the supply roller 4. The supply roller 4 allows the toner to be attached to the surface of the developing roller 3. The regulator 6 forms a toner layer having a uniform thickness on the surface of the developing roller 3. A developing bias voltage is applied to the developing roller 3. The toner that is transferred to the development nip D as the developing roller 3 rotates is attached to the electrostatic latent image that is formed on the surface of the photoconductive drum 1, due to the developing bias voltage. Thus, a visible toner image is formed on the surface of the photoconductive drum 1. The recording medium P picked up from a recording medium tray 501 by a pick-up roller 502 is transferred to the transfer nip between the transfer roller 300 and the photoconductive drum 1 by a transporting roller 503. When a transfer bias voltage is applied to the transfer roller 300, the toner image formed on the photosensitive drum 110 is transferred to the recording medium P by electrostatic attraction. The toner image transferred to the recording medium P is fixed to the recording medium P by being subjected to the heat and pressure applied from the fixing unit 400, and thus, the printing is completed. The recording medium P is externally discharged by a discharge roller 504. The toner remaining on the surface of the photoconductive drum 1 without being transferred to the recording medium P is removed by a cleaning member 7 and retained in a waste toner retaining unit 30.

While the present general inventive concept is particularly illustrated and described with reference to exemplary embodiments thereof, it will be understood by those of ordinary skill in the art that various changes in form and details may be made therein without departing from the spirit and scope of the present general inventive concept as defined by the following claims.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing device including a housing containing toner and having an opening at a side thereof, a developing roller supplying the toner supplied through the opening to a photoconductive drum, and a regulator contacting the outer circumference of the developing roller to regulate the amount of the toner supplied to the photoconductive drum, the housing comprising:

a lower frame having side portions and a lower end portion to respectively form both edges and a lower edge of the opening in a lengthwise direction; and an upper frame welded and coupled to the lower frame and including a leading end portion to form an upper edge of the opening and a recess portion recessed from the leading end portion at both end portions of the leading end portion in the lengthwise direction, wherein both side portions of the lower frame comprise a first surface to contact the recess portion to prevent the upper frame from being pushed toward the developing roller when the upper frame is welded and coupled to the lower frame.

2. The developing device of claim 1, wherein the regulator comprises:

a support portion coupled to the housing; and a blade portion extending downwardly from the support portion and having an end portion contacting the outer circumference of the developing roller in the lengthwise direction.

3. The developing device of claim 2, further comprising a first upper sealing member provided at the leading end portion in the lengthwise direction and contacting an inner surface of the blade portion to prevent leakage of toner through an upper edge of the opening.

4. The developing device of claim 3, wherein the first upper sealing member is attached to the leading end portion using a double-sided adhesive tape, a first side sealing member is provided on a surface of both side portions of the lower frame, the surface facing the developing roller, and contacts the outer circumference of the developing roller and the inner surface of the blade portion to prevent leakage of the toner through both side edges of the opening, and a second upper sealing member overlapping both end portions of the first upper sealing member and the first side sealing member is provided on the inner surface of the blade portion in the lengthwise direction.

5. The developing device of claim 3, wherein the first upper sealing member is a foam elastic member that is coated in a liquid state on the leading end portion and foamed thereon.

6. The developing device of claim 5, wherein the foam elastic member comprises:

a first sealing portion located at the leading end portion; and a second sealing portion filling a gap between each of both side portions of the lower frame and each of both end portions of the leading end portion in the lengthwise direction, wherein the foam elastic member substantially has an "H" shape.

7. The developing device of claim 6, wherein the upper frame comprises a blocking rib located between each of both side portions of the lower frame and each of both end portions of the leading end portion and blocking the foam elastic member in a liquid state coated to form the second sealing portion from intruding inside the leading end portion.

8. The developing device of claim 7, wherein the interval between each of both side portions and the blocking rib is 0.7 mm-1.5 mm.

9. The developing device of claim 3, further comprising:

a first side sealing member provided on a surface of both side portions of the lower frame, the surface facing the developing roller, and contacting the outer circumference of the developing roller and the inner surface of the blade portion to prevent leakage of the toner through both side edges of the opening; and a lower sealing member located at a lower end portion of the lower frame and contacting the outer circumference of the developing roller to prevent leakage of the toner through a lower edge of the opening.

10. The developing device of claim 9, wherein a second side sealing member is provided at each of both end portions of the blade portion in the lengthwise direction, overlapping the first upper sealing member and the first side sealing member provided on a surface of both side portions of the lower frame, to prevent leakage of the toner between the first upper sealing member and the side sealing member.

11. The developing device of claim 3, wherein the leading end portion has an "L" shape to support the first upper sealing member to not be pushed down by the regulator.

12. The developing device of claim 1, further comprising a welding thread and a welding root surrounding a toner accommodation space except for the opening that are respectively provided at the upper frame and the lower frame, and at least a part of the welding thread and the welding root is inclined in a vertical direction.

13. An electrophotographic image forming apparatus comprising:

the developing device including a housing containing toner and having an opening at a side thereof, a developing roller supplying the toner supplied through the opening to a photoconductive drum, and a regulator contacting the outer circumference of the developing roller to regulate the amount of the toner supplied to the photoconductive drum, the housing comprising:

a lower frame having side portions and a lower end portion to respectively form both edges and a lower edge of the opening in a lengthwise direction; and an upper frame welded and coupled to the lower frame and including a leading end portion to form an upper edge of the opening and a recess portion recessed from the leading end portion at both end portions of the leading end portion in the lengthwise direction, wherein both side portions of the lower frame comprise a first surface to contact the recess portion to prevent the upper frame from being pushed toward the developing roller when the upper frame is welded and coupled to the lower frame;

an optical scanning unit scanning light modulated according to an image signal, onto the photoconductive drum;

a transfer unit transferring a toner image formed on the photoconductive drum to a recording medium; and a fixing unit fixing the toner image by applying heat and pressure to the recording medium.

14. The electrophotographic image forming apparatus of claim 13, wherein the regulator comprises:

a support portion coupled to the housing; and a blade portion extending downwardly from the support portion and having an end portion contacting an outer circumference of the developing roller in a lengthwise direction, wherein the developing device comprises a first upper sealing member provided at the leading end portion in the lengthwise direction and contacting an inner surface of the blade portion to prevent leakage of toner through the upper edge of the opening.

15. The image forming apparatus of claim 14, wherein the first upper sealing member is attached to the leading end portion using a double-sided adhesive tape, a first side sealing member is provided on a surface of both side portions of the lower frame, the surface facing the developing roller, and contacts the outer circumference of the developing roller and the inner surface of the blade portion to prevent leakage of the toner through both side edges of the opening, and a second upper sealing member to overlap both end portions of the first upper sealing member and the first side sealing member is provided on the inner surface of the blade portion in the lengthwise direction.

16. The image forming apparatus of claim 14, wherein the first upper sealing member is a foam elastic member that is coated in a liquid state on the leading end portion and foamed thereon.

17. The image forming apparatus of claim 16, wherein the foam elastic member comprises:

a first sealing portion located at the leading end portion; and a second sealing portion filling a gap between each of both side portions of the lower frame and each of both end portions of the leading end portion in the lengthwise direction, wherein the foam elastic member substantially has an "H" shape.

18. The image forming apparatus of claim 14, further comprising:

a first side sealing member provided on a surface of both side portions of the lower frame, the surface facing the developing roller, and contacting the outer circumference of the developing roller and the inner surface of the blade portion to prevent leakage of the toner through both side edges of the opening;

a lower sealing member located at a lower end portion of the lower frame and contacting the outer circumference of the developing roller to prevent leakage of the toner through a lower edge of the opening; and a second side sealing member provided at each of both end portions of the blade portion in the lengthwise direction, overlapping the first upper sealing member and the first side sealing member, to prevent leakage of the toner between the first upper sealing member and the side sealing member.

19. The image forming apparatus of claim 14, wherein the leading end portion has an "L" shape.

20. The image forming apparatus of claim 13, wherein a welding thread and a welding root surrounding a toner accommodation space except for the opening are respectively provided at the upper frame and the lower frame, and at least a part of the welding thread and the welding root is inclined in a vertical direction.

21. The developing device of claim 1, wherein the lower frame receives the developing roller.

* * * * *